United States Patent [19]

Gault

[11] Patent Number: 4,535,647

[45] Date of Patent: Aug. 20, 1985

[54] CONTROL HANDLE ARRANGEMENT FOR POWER TAKEOFF VALVE

[75] Inventor: Roger T. Gault, Wild Rose, Wis.

[73] Assignee: Ingersoll Equipment Co., Inc., Winneconne, Wis.

[21] Appl. No.: 488,367

[22] Filed: Apr. 25, 1983

[51] Int. Cl.[3] ..... G05G 1/10

[52] U.S. Cl. ..... 74/543; 74/473 R; 74/532

[58] Field of Search ..... 74/473 R, 532, 523, 74/526, 543; 251/231, 234, 252

[56] References Cited

U.S. PATENT DOCUMENTS

| | | | |
|---|---|---|---|
| 613,041 | 10/1898 | Kamerer | 251/231 |
| 2,014,759 | 9/1935 | Clay | 251/231 |
| 2,265,260 | 12/1941 | Argo | 74/473 R |
| 2,427,461 | 9/1947 | Johnson | 251/231 |
| 3,268,204 | 8/1966 | Grove | 251/234 |
| 3,975,971 | 8/1976 | Radenovic | 74/473 R |
| 4,078,449 | 3/1978 | Kelly | 74/526 |

*Primary Examiner*—Gary L. Smith

*Assistant Examiner*—Michael F. Trettel

*Attorney, Agent, or Firm*—Dressler, Goldsmith, Shore, Sutker & Milnamow, Ltd.

[57] ABSTRACT

A control arrangement is disclosed which is particularly suited for selective operation of a reciprocable member, such as the valve spool of a hydraulic power takeoff valve on a material handling implement. The arrangement includes a handle bracket which is adapted to be mounted in association with the hydraulic valve, and further includes a control handle adapted for releasable connection with the spool of the valve. The movement of the handle is guided by the handle bracket such that in a first position of the handle with respect to the valve spool, the handle can be positioned within a detent notch in the bracket for maintaining the valve spool out of its neutral position in opposition to its associated centering springs. The control handle can further be connected to the control member in a second position. In this second position, the handle is no longer receivable within the detent notch, thus requiring continued manipulation of the handle to maintain the valve spool out of its center, neutral position.

9 Claims, 5 Drawing Figures

CONTROL HANDLE ARRANGEMENT FOR POWER TAKEOFF VALVE

TECHNICAL FIELD

The present invention relates generally to control handle arrangements, and more particularly to a control handle arrangement for selectively operating a power takeoff hydraulic valve on an associated material handling implement, including a selectively positionable control handle in one position of which can be manipulated to maintain the associated valve in a predetermined position.

BACKGROUND OF THE INVENTION

Many material handling implements include so-called "power takeoff" arrangements which permit the power source of the implement to drive an associated device, such as a rotary tiller, a wood splitter, or a like attachment. Such power takeoffs can comprise a mechanical power source, such as a driven shaft, or alternately can comprise a hydraulic valve arrangement for supplying pressurized fluid from the material handling implement to a hydraulic motor or the like on an associated attachment. Such arrangements are highly desirable for enhancing the versatility of material handling implements since they permit a wide variety of driven attachments to be operated by the source of power on the implement.

The preferred manner in which a hydraulic power takeoff valve is controlled in part depends upon the type of attachment to be operated. For example, when a rotary tiller is attached to a tractor with its power takeoff valve supplying pressurized fluid to the tiller's hydraulic motor, it is ordinarily preferable to provide a control arrangement which permits the hydraulic valve to be releasably maintained in an "on" position, thus freeing the hands of the operator for guiding the tractor. In contrast, a device such as a hydraulic wood splitter is usually operated by discrete periods of fluid pressurization, rather than continuous pressurization. Accordingly, efficient splitter operation requires a control arrangement for the tractor's power takeoff valve that is configured to permit selective fluid pressurization of the hydraulic actuator of the splitter, with the control arrangement permitting the valve to return to a centered, neutral position when the control handle is released.

In one previously known control arrangement, a control handle and a handle bracket are provided for selectively moving the spool of a hydraulic power takeoff valve. In this previous arrangement, the handle bracket includes a pair of spaced apart wall portions which are positioned on generally opposite sides of one end of the valve spool. The control handle pivots with respect to one of the wall portions as it is moved within a guide slot defined by the other wall portion. The handle is pivotally interconnected with the valve spool between the opposed wall portions of the bracket so that movement of the control handle reciprocably moves the valve spool.

The above-described previous control arrangement has typically been employed in association with a self-centering hydraulic valve. In order to permit the valve to be maintained at one end of its stroke against the action of its centering spring, a detent is provided adjacent the guide slot within which the handle is movable. By positioning the handle in the detent, the valve spool is maintained in a position such that a continuous supply of pressurized fluid is provided to an associated device, such as for continuous operation of a rotary tiller.

While this type of control arrangement desirably permits "hands off" operation of the power takeoff valve for continuous pressurized fluid supply, such an arrangement is not as well suited for use with a device such as a wood splitter since non-continuous fluid supply is usually desired. With the above control arrangement, inadvertent movement of the control handle into the detent can cause the supply of pressurized fluid to continue even though an associated hydraulic actuator (such as on the splitter) has moved through its full stroke. Additionally, the above control arrangement usually is configured to facilitate convenient operation from the control area of the associated tractor, with manipulation of the control arrangement from behind the tractor (such as for operation of a wood splitter) being somewhat less convenient.

In view of the foregoing, it is desirable to provide a control arrangement such as for operation of a self-centering, hydraulic power takeoff valve which in one mode of operation facilitates maintaining the valve in an "on" position, while in another mode of operation permitting the valve to self-center when the handle of the control arrangement is released.

SUMMARY OF THE INVENTION

In accordance with the present invention, a control handle arrangement is disclosed which is particularly suited for use in association with a hydraulic power takeoff valve on an implement which is adapted to supply pressurized fluid to hydraulically driven attachments. Because valves of this nature are typically self-centering, the control arrangement includes a handle which can be operatively connected to the valve in a first position so that manipulation of the handle permits the spool of the valve to be maintained in an operating position against the action of its centering springs. Since operation of some attachments requires that the power takeoff valve centers to its neutral position when the control handle is released, the control handle can be disposed in a second position wherein the arrangement for holding the valve spool against its centering springs cannot be operated.

The present control handle arrangement is adapted for use in selectively moving a reciprocable valve spool or like control member, and includes a handle bracket adapted for mounting in association with the valve. The handle bracket includes a base portion through which the valve spool is adapted to extend, and further includes spaced apart, first and second wall portions which extend from the base portion on respective opposite sides of the valve spool.

The control arrangement further includes a control handle adapted to be mounted in association with the handle bracket, preferably such that the handle extends through the first and second wall portions of the bracket. Means are provided for releasably pivotally connecting the control handle to the valve spool such that as the handle pivots with respect to the second wall portion of the bracket, the handle is movable within a guide slot defined by the first wall portion so that the reciprocable spool member is moved from a first, neutral position to a second position.

As discussed above, it is sometimes desirable for the valve spool to be maintained in a non-neutral position without continued manipulation of the control handle.

For other operations, it can be desirable to only permit continued displacement of the spool from its neutral position by continued manipulation of the control handle. Accordingly, the present control arrangement includes selectively operable means for retaining the control handle in a position such that the valve spool is maintained in its second, non-neutral position. The retaining means comprises a detent notch defined by the first wall portion of the handle bracket, with the detent notch preferably extending generally transversely of the guide slot defined by that wall portion. In order to permit the control handle to be positioned and retained within the detent notch, the control handle includes a portion of reduced cross-section.

Notably, the retaining means of the present arrangement are adapted to only operate when the control handle is in a first position with respect to the valve spool and the handle bracket. In distinction, the reduced portion of the control handle is not receivable within the detent notch in a second position of the control handle with respect to the valve spool and the handle bracket. The releasable pivotal connection of the control handle to the valve spool permits the control handle to be readily releasable positioned in either of its first or second positions, with the handle being movable from one position to the other by merely rotating it through an arc of 180 degrees.

The control handle is preferably configured such that its gripping portion, which is adapted to be grasped by an operator, is positioned generally forwardly (with respect to the associated implement) of the valve spool in the first position of the handle. In distinction, in the second position of the control handle, the gripping portion is positioned generally rearwardly of the valve spool. This preferred configuration permits the control handle to be easily positioned within the detent notch of the handle bracket for continuing displacement of the valve spool when the operator is seated in the control area of the implement. This facilitates continuous operation of an attachment to the implement, such as a rotary tiller. In contrast, the configuration of the control handle permits it to be easily manipulated from behind the implement when the handle is in its second position, bearing in mind that in its second position its reduced portion is not receivable within the detent notch of the handle bracket. Thus, the valve spool is displaced only by continued manipulation of the control handle, the type of action which is desirable for the power takeoff valve for supplying pressurized fluid to an attachment such as a wood splitter.

Numerous other features and advantages of the present invention will become readily apparent from the following detailed description and accompanying drawings.

DETAILED DESCRIPTION

Figure 1:
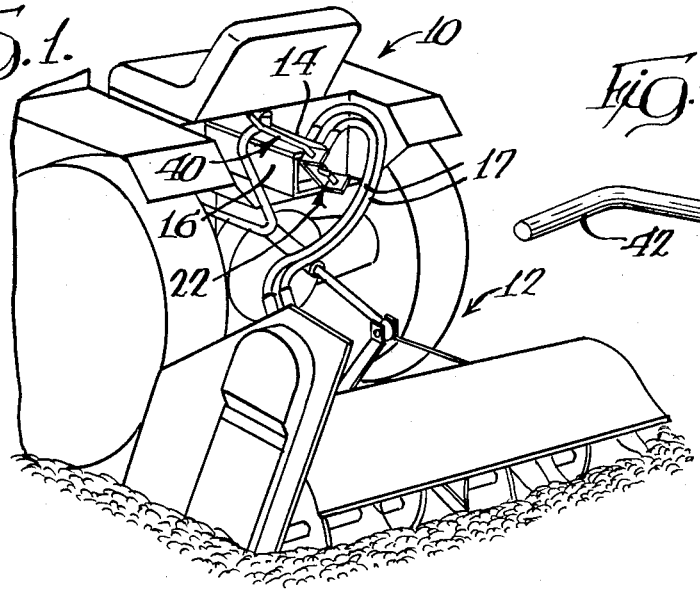
FIG. 1 is a partial perspective view of a material handling implement having a rotary tiller attachment thereon, with control of the attachment provided by an arrangement in accordance with the present invention.

While the present invention is susceptible of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Referring now to FIG. 1, therein is illustrated a material handling implement 10, shown as a tractor, with which the present invention is particularly suited for use. A rotary tiller 12 is illustrated as attached to tractor 10, with this type of attachment typically including a hydraulic motor for rotating the cultivating tines of the tiller. As will be recognized, this type of attachment is adapted to be supplied with pressurized fluid from tractor 10, which ordinarily includes a hydraulic pump which supplies fluid via a suitable valve on the tractor.

Accordingly, a hydraulic power takeoff valve 14 (sometimes referred to as a PTO valve) is provided on tractor 10, and is mounted thereon with bracket 16. Typically, hydraulic valve 14 comprises a self-centering spool valve which is adapted to selectively provide pressurized hydraulic fluid flow to rotary tiller 12 via hydraulic lines 17.

Figure 3:
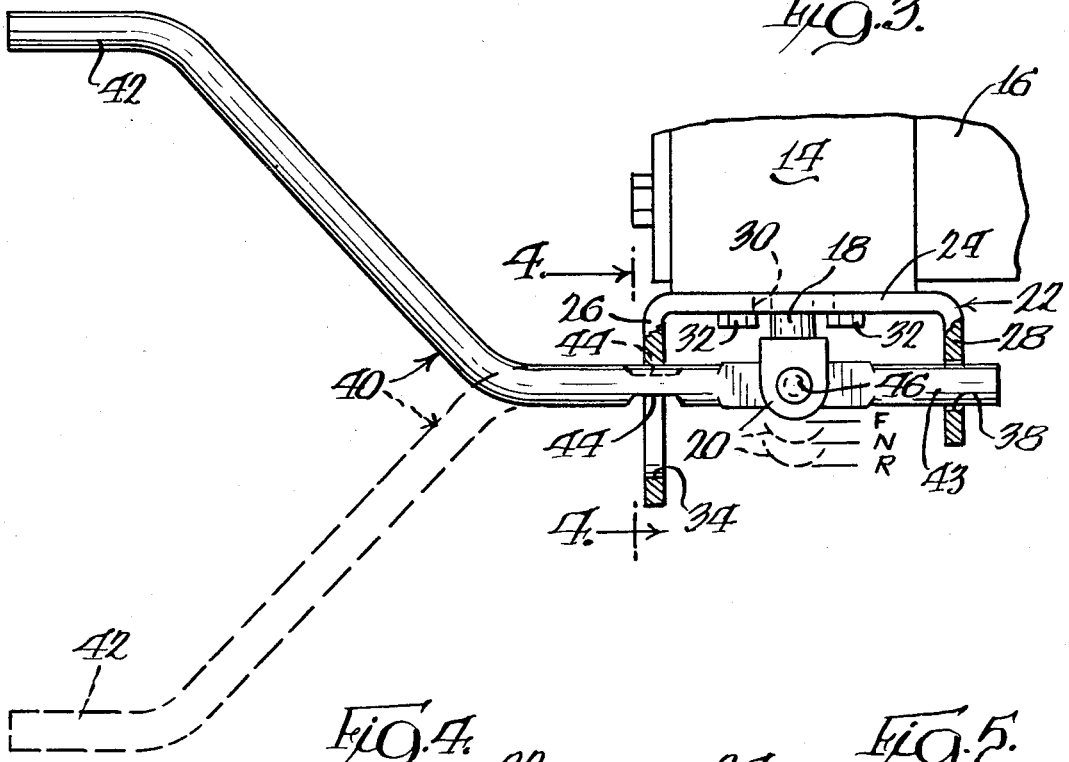
FIG. 3 is a plan view in partial cross-section of the present control handle arrangement illustrated with an associated hydraulic valve.

With further reference to FIG. 3, hydraulic valve 14 includes a reciprocable valve spool 18 which is movable within the body of the valve. The valve spool includes a spool clevis 20 adapted for operative interconnection with the control arrangement of the present invention. Thus, the valve spool 18 represents a control member which the present control arrangement is adapted to operate. As best illustrated in FIG. 3, the valve spool is typically movable from a center, first neutral position (designated "N") in opposite directions against the action of centering springs provided within the valve 14. Thus, FIG. 3 illustrates the valve spool 18 displaced from its neutral position to a second, forward position designated "F." Similarly, the valve spool 18 is movable in an opposite direction from its neutral position to a further, reverse position, designated "R." The direction in which valve spool 18 is moved from its neutral position determines the direction of pressurized fluid flow within lines 17 from the hydraulic valve 14 to the attachment on tractor 10, with the forward and reverse positions of the valve spool defining the total length of its stroke.

Figure 2:
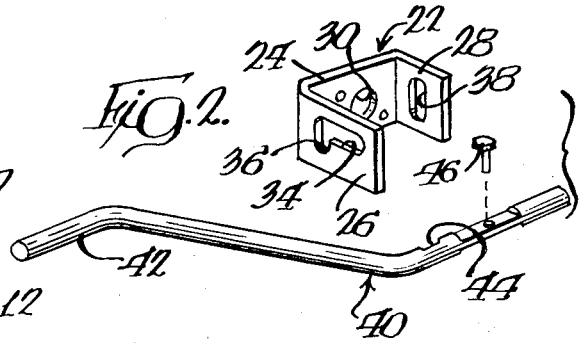
FIG. 2 is an exploded view of the components of the present control handle arrangement.

Referring to FIGS. 2 and 3, the control arrangement of the present invention is illustrated. The present control arrangement is adapted for selectively moving the valve spool 18 of hydraulic valve 14, and is readily adaptable for selectively moving a like reciprocable control member. The control arrangement includes a generally U-shaped handle bracket 22 which is adapted to be mounted in association with hydraulic valve 14. The bracket 22 includes a base wall portion 24 from which extend spaced apart, first and second wall portions 26 and 28 such that the wall portions 26 and 28 are disposed on respective opposite sides of clevis 20 of valve spool 18. To this end, the base wall portion 24 defines a spool opening 30 through which valve spool 18 extends, with a pair of fasteners 32 being adapted to extend through the base wall portion 24 for affixing the bracket 22 in association with hydraulic valve 14.

The handle bracket 22 is adapted to receive a control handle as will be further described, and in this regard each of first and second wall portions 26 and 28 defines an opening through which the control handle preferably is adapted to extend. The first wall portion 26 defines a generally elongated handle guide slot 34 which extends in a direction generally parallel to the direction of reciprocable movement of valve spool 18. The first wall portion 26 further defines a detent notch or slot 36 associated with and which opens into guide slot 34, and preferably extends generally transversely from the guide slot 34 (i.e. generally transversely to the direction of reciprocable movement of valve spool 18).

Second wall portion 28 of handle bracket 22 preferably defines a pivot slot 38 which also extends generally transversely of guide slot 34, and likewise generally transversely of the direction of reciprocable movement of valve spool 18.

In order to permit selective movement of valve spool 18 of hydraulic valve 14, the present control arrangement further includes a control handle generally designated 40. Handle 40 includes a gripping portion 42 adapted for manipulation by an operator, and a shank portion 43 which is offset from gripping portion 42, and is preferably adapted to extend through both of first and second wall portions 26 and 28 of handle bracket 22. By this arrangement, handle 40 is pivotal with respect to second wall portion 28 as the shank 43 is moved within guide slot 34 for moving valve spool 18 in opposite directions from its neutral position.

Figure 4:
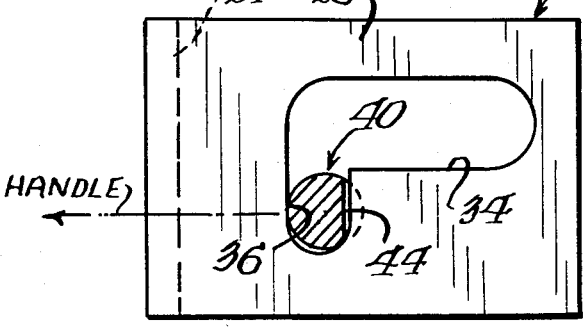
FIG. 4 is a view taken generally along lines 4—4 of FIG. 3 illustrating operation of the present arrangement with its control handle in a first position.

As discussed, it is sometimes desirable to maintain valve spool 18 out of its neutral position without continued manipulation of control handle 40. To this end, the shank portion of handle 40 includes a portion 44 of relatively reduced cross-section. The reduced section 44 is adapted to be received within the detent notch 36 in second wall portion 26 of bracket 22 when handle 40 is in a first position with respect to the handle bracket and the valve spool 18. This first position of handle 40 is illustrated in solid line in FIG. 3, and is further illustrated in FIG. 4. In this position of the handle, valve spool 18 can be moved in opposite directions from its neutral position, with movement of handle 40 in a first direction moving the valve spool 18 to its second, forward position. Subsequent movement of handle 40 in a second direction transverse to its first direction of movement positions reduced portion 44 in detent notch 36, thus maintaining valve spool 18 in its second, forward position.

The operative interconnection of control handle 40 with clevis 20 of valve spool 18 is provided by a removable spool pivot fastener 46. By this arrangement, the control handle 40 is releasably pivotally connected with the valve spool 18. In the preferred embodiment, movement of reduced portion 44 of handle 40 into detent notch 36 is accommodated by pivotal movement of handle 40 about an axis generally defined by the centerline of reciprocable movement of the valve spool 18. Pivotal movement in this manner is accommodated by the elongated configuration of pivot slot 38 in second wall portion 28, with valve spool 18 either pivoting with handle 40, or with the operative interconnection at fastener 46 configured to permit limited pivotal movement of the handle with respect to the clevis 20 of valve spool 18.

Thus, in the first position of control handle 40, the handle is movable within guide slot 34 for displacing valve spool 18 in opposite directions from its first, neutral position. If it is desired to maintain valve spool 18 in its second, forward position, handle 40 is moved within guide slot 34 until reduced portion 44 is receivable within detent notch 36, and the handle then moved so that portion 44 is positioned within detent notch 36, thus locking valve spool 18 in its second position against the action of the spool centering springs. It will be noted that the preferred configuration of gripping portion 42 of the handle 40 is such that the gripping portion is positioned generally forwardly of the valve 14, thus facilitating convenient operation of the valve 14 such as from the seat of tractor 10 (see FIG. 1 in which handle 40 is illustrated in its first position).

Figure 5:
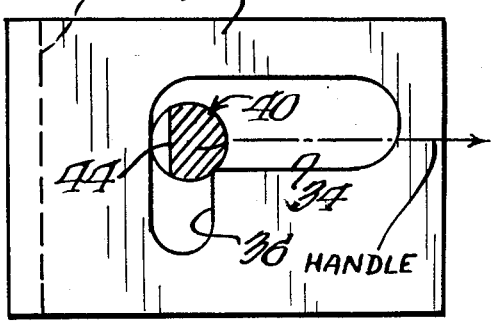
FIG. 5 is a view similar to FIG. 4 illustrating the control handle of the present arrangement in a second position.

The releasable nature of pivot fastener 46 permits control handle 40 to be easily repositioned into a second position with respect to handle bracket 22 and valve spool 18. In this second position, which is illustrated in phantom line in FIG. 3, and is further illustrated in FIG. 5, the operating characteristics of the control arrangement are altered, in that the handle-retaining detent arrangement is inoperable. The reorientation of reduced portion 44 prevents the reduced portion from being received within detent notch 36 when handle 40 has been moved to move valve spool 18 from its neutral position to its second, forward position. This type of operation is desirable when the attachment on tractor 10 comprises a wood splitter or the like since it would be undesirable to override the self-centering action of power takeoff valve 14.

Handle 40 can be easily moved from its first position to its second position by removing fastener 46, and merely rotating the handle through an arc of 180 degrees. It will be noted that in the second position of handle 40 with respect to valve spool 18 and bracket 22, gripping portion 42 is positioned generally rearwardly of hydraulic valve 14 (with respect to tractor 10) thus permitting convenient manipulation of the handle from behind the tractor. This facilitates operation of the valve such as for operating a wood splitter, since ordinarily an operator stands alongside of the rearwardly projecting splitter. Thus, in the second position of handle 40, the handle is not only easily manipulated, but the arrangement prevents the handle from moving into the detent notch 36, thus requiring continued manipulation of handle 48 for continued operation of hydraulic valve 14.

From the foregoing, it will be observed that numerous variations and modifications may be effected without departing from the true spirit and scope of the concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. A control handle arrangement for selectively moving a reciprocable valve member of a self-centering valve, comprising:

handle bracket means adapted for mounting in association with said valve member, said bracket means defining a guide slot;

control handle means adapted to be mounted in association with said bracket means and extend through said guide slot of said bracket means, said handle means being adapted for releasable operative connection with said valve member for selectively positioning said handle means in either of first and second positions with respect to said valve member and said bracket means, whereby movement of said handle means in a first direction within said guide slot of said bracket means moves said valve member from a first neutral position thereof to a second position thereof; and selectively operable retaining means for retaining said handle in a position in which said valve member is maintained in said second position thereof, said retaining means comprising detent means defined by said bracket means in operative association with said guide slot, said retaining means being operable by movement of said handle means into said detent means when said handle means is operatively connected to said valve member in said first position of said handle means, said retaining means being inoperable whereby said handle means cannot be moved into said detent means when said handle means is operatively connected with said valve member in said second position of said handle means.

2. The control handle arrangement in accordance with claim 1, wherein said handle means is movable in a second direction transverse to said first direction for operating said retaining means.

3. The control handle arrangement in accordance with claim 1, wherein said retaining means further comprises a portion of said handle means of relatively reduced cross-section, said reduced portion of said handle means being receivable within said detent means when said handle means is in said first position thereof with respect to said valve member and bracket means, while in said second position of said handle means said reduced portion is not receivable within said detent means.

4. A control handle arrangement for selectively moving a reciprocable valve member, comprising:

handle bracket means adapted for mounting in association with said valve member;

control handle means adapted to be mounted in association with said bracket means, said handle means being adapted for releasable operative connection with said valve member in first and second positions of said handle with respect to said valve member and said bracket means, whereby movement of said handle means in a first direction moves said valve member from a first neutral position thereof to a second position thereof; and selectively operable retaining means for retaining said handle in a position in which said valve member is maintained in said second position thereof, said retaining means being operable when said handle means is operatively connected to said valve member in said first position of said handle means, said retaining means being inoperable when said handle means is operatively connected with said valve member in said second position of said handle means, said handle means being movable in a second direction transverse to said first direction for operating said retaining means, said bracket means including a first wall portion defining a guide slot within which said handle means is movable in said first direction, said retaining means comprising detent means defined by said first wall portion in association with said guide slot;

said retaining means further comprising a portion of said handle means of relatively reduced cross-section;

said retaining means operating such that in said first position of said handle means, said reduced portion is receiveable within said detent means, while in said second position of said handle means said reduced portion is not receivable within said detent means.

5. The control handle arrangement in accordance with claim 4, wherein said bracket means comprises a handle bracket including a base portion through which said valve member extends, and a second wall portion, said first and second wall portions being spaced apart and extending from said base portion on respective opposite sides of said valve member, said second wall portion defining a pivot slot with which said handle means coacts for pivotal movement of said handle means with respect to said second wall portion for moving said valve member, and including means for releasably pivotally connecting said handle means with said control member.

6. The control handle arrangement in accordance with claim 5, wherein said detent means comprises a detent notch extending transversely of said guide slot, said pivot slot extending transversely of said guide slot to accommodate movement of said reduced portion into said detent notch as said handle means pivots about an axis generally defined by the centerline of reciprocable movement of said valve member.

7. A control handle arrangement for selectively moving a reciprocable valve spool of a self-centering valve on an associated material handling implement, comprising:

a handle bracket adapted for mounting in association with said valve, and including a base portion through which said valve spool is adapted to extend, and further including spaced apart, first and second wall portions extending from said base portion on respective opposite sides of said valve spool;

a control handle adapted to extend through said first and second wall portions and move within a guide slot defined by said first wall portion as said handle pivots with respect to said second wall portion;

means for releasably pivotally connecting said control handle with said valve spool so that said valve spool is movable from a first neutral position to a second position as said handle is moved in said guide slot; and means for selectively retaining said control handle in a position wherein said valve spool is maintained in said second position thereof, said retaining means including a detent notch defined by said first wall portion of said handle bracket and opening into said guide slot, said retaining means further including a portion of said control handle of relatively reduced cross-section, whereby said reduced portion is receivable within said detent notch in a first position of said control handle with respect to said valve spool for maintaining said valve spool in said second position thereof, while in a second position of said handle with respect to said valve spool said reduced portion is not receivable within said detent notch.

8. The control handle arrangement in accordance with claim 7, wherein said second wall portion of said handle bracket defines a pivot slot through which said control handle extends, said pivot slot extending transversely of said guide slot in said first wall portion so that said control handle is pivotal about an axis defined by the movement of said valve spool for moving said reduced portion into said detent notch.

9. The control handle arrangement in accordance with claim 7, wherein said control handle includes a gripping portion adapted for manipulation by an operator, said gripping portion being positioned generally forwardly of said valve, with respect to said implement, in said first position of said control handle, said gripping portion being positioned generally rearwardly of said valve, with respect to said implement, in said second position of said control handle.

* * * * *